US005163827A

United States Patent [19]

Sumida

[11] Patent Number: 5,163,827

[45] Date of Patent: Nov. 17, 1992

[54] AXIAL FLOW FLUID COMPRESSOR WITH SPECIFIC BLADE DIMENSIONS

[75] Inventor: Kazuhisa Sumida, Kanagawa, Japan

[73] Assignee: Kabushiki Kaisha Toshiba, Kanagawa, Japan

[21] Appl. No.: 819,777

[22] Filed: Jan. 13, 1992

[30] Foreign Application Priority Data

Jan. 14, 1991 [JP] Japan ..... 3-014677

[51] Int. Cl.[5] ..... F04C 18/00

[52] U.S. Cl. ..... 418/220; 417/356; 418/152

[58] Field of Search ..... 417/356; 418/220, 179

[56] References Cited

U.S. PATENT DOCUMENTS

| | | | |
|---|---|---|---|
| 2,401,189 | 5/1946 | Quiroz | 418/220 |
| 4,403,930 | 9/1983 | Kodama | 418/121 |
| 4,871,304 | 10/1989 | Iida et al. | 418/220 |
| 4,872,820 | 10/1989 | Iida et al. | 418/220 |
| 4,875,842 | 10/1989 | Iida et al. | 418/220 |
| 5,026,264 | 6/1991 | Morozumi et al. | 418/220 |
| 5,028,222 | 7/1991 | Iida et al. | 418/220 |

FOREIGN PATENT DOCUMENTS

| | | | |
|---|---|---|---|
| 3839889A1 | 11/1988 | Fed. Rep. of Germany . | |
| 64-36990 | 2/1989 | Japan . | |
| 64-36991 | 2/1989 | Japan . | |
| 2-19683 | 1/1990 | Japan | 418/220 |
| 2-199289 | 8/1990 | Japan | 418/220 |
| 2-201076 | 8/1990 | Japan | 418/220 |
| 2-201078 | 8/1990 | Japan | 418/220 |
| 2-201093 | 8/1990 | Japan | 418/220 |
| 2-291491 | 12/1990 | Japan | 418/220 |
| 2214236A | 8/1989 | United Kingdom . | |

*Primary Examiner*—Richard A. Bertsch
*Assistant Examiner*—Roland McAndrews
*Attorney, Agent, or Firm*—Finnegan, Henderson, Farabow, Garrett and Dunner

[57] ABSTRACT

A compressor includes a cylinder, and a rotating body located in the cylinder, and a helical groove formed on the outer periphery of the rotating body. A helical blade is fitted in the groove and divides the space between the inner periphery of the cylinder and the outer periphery of the rotating body into operating chambers which have volumes gradually decreasing with distance from one end of the cylinder. The helical blade has dimensions satisfying the following formula:

$$(1+\mu^2)(\alpha/\beta)<(L+\mu B)$$

in which

B: axial width, T: radial height, L: exposed height, and $\mu$: frictional coefficient, and in which $$\alpha=(B^2+2TL-L^2)/2+\{-B^2(1-\mu^2)+\mu BT+\mu^2TL\}/(1-\mu^2)$$

$$\beta=T-L+\{\mu B(1+\mu^2)+(2\mu(\mu(\mu T-B)\}/(1-\mu^2).$$

12 Claims, 5 Drawing Sheets

Fig 12(a

AXIAL FLOW FLUID COMPRESSOR WITH SPECIFIC BLADE DIMENSIONS

BACKGROUND OF THE INVENTION

1. Field of the Invention

The present invention relates to a fluid compressor which is assembled in a refrigerating cycle of an air conditioner or refrigerator, and more especially to a compressor accommodating a helical blade in a compressing mechanism.

2. Description of the Related Art

Various kind of refrigerators such as air conditioners for cooling and heating air in a room, refrigerator or showcase, has a refrigeration cycle in which a compressor is accommodated to compress recycling refrigeration medium. Heretofore, for use in these refrigeration cycles, a reciprocating compressor and rotary compressor are well known.

Recently, a new type compressor having a helical blade has been in developed for use in place of reciprocal or rotary type compressors. A feature of this type of compressor is that it has a reduced number of assembled parts, has a simplified compressing mechanism to improve compression efficiency and realize apparatus cost reduction, and also it has merits to reduce noise and/or vibration because there is substantially no eccentric mass in a rotating portion thereof. Such new type compressor is disclosed in U.S. Pat. Nos. 4,871,304, 4,872,820 and 4,875,842.

However, there can be problems in a compressor of the type having mounted therein a helical blade in a compressor mechanism. Thus, in a compressor of this type, the helical blade is designed so as to move freely in the radial direction, in and out along a helical groove formed on the roller piston at a disparity pitch. During operation, this helical blade separates high and low pressure regions respectively and can experience elastic deformation. For this reason, the helical blade is affected by the force caused by the pressure difference between high and low pressure regions. Because of this force, there are several problems by which the helical blade tends to deform, wear, break and/or to reduce durability thereof.

SUMMARY OF THE INVENTION

Accordingly, the object of this invention is to provide a compressor with helical blade of long durability without complication of the construction thereof in the compressor of the type accommodating a helical blade in the compressor mechanism.

In order to achieve the above object, a compressor according to the present invention comprises: a rotatively driven cylinder, a roller piston installed in the cylinder in an eccentric manner and rotatable in synchronism with the cylinder, a helical groove formed on a peripheral surface of the piston, and a helical blade accommodated in the groove in a freely movable radially in and out from said groove. The helical blade has a width B in the direction along the axis of the roller piston, a height T in the direction perpendicular to the axial direction, an exposing height L measured from the helical groove, and a frictional coefficient $\mu$, the width B satisfying following formula:

$$(1+\mu^2)(\alpha/\beta)<(L+\mu B)$$

in which $$\alpha=(B+2TL-L^2)/2+\{-B^2(1-\mu^2)+\mu BT+\mu^2TL\}/(1-\mu^2)$$

$$\beta=T-L+\{\mu B(1+\mu^2)+2\mu(\mu T-B)\}/(1-\mu^2)$$

respectively.

DESCRIPTION OF THE PREFERRED EMBODIMENTS

In the following, an embodiment of this invention is described with reference to the accompanying drawing.

Figure 1:
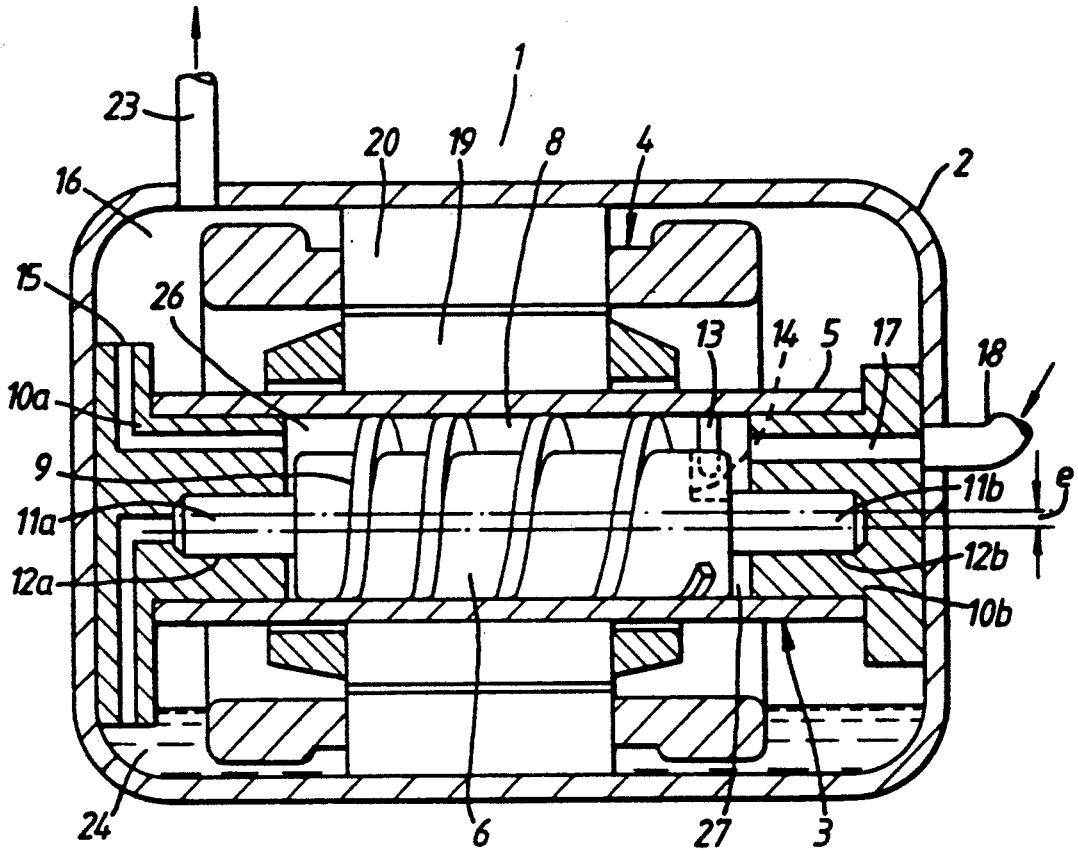
FIG. 1 is a longitudinal sectional view showing the general construction of the compressor in accordance with the invention.
Figure 2:
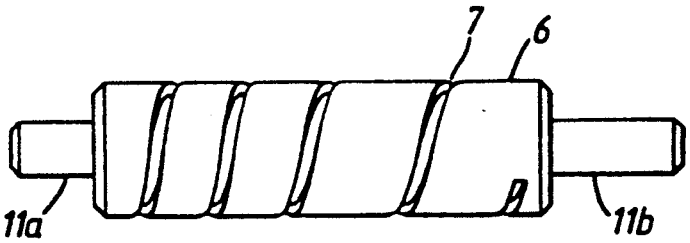
FIG. 2 is a side view the showing roller piston component of the compressor shown in FIG. 1, in accordance with the invention.

FIG. 1 shows a longitudinal cross-sectional view of the compressor of one embodiment of the invention. This compressor 1 generally has a closed type casing 2, a compressor mechanism 3 accommodated in the closed type casing 2, and an electric motor 4 providing rotating power to the compressor mechanism 3.

The compressor mechanism 3 has a cylinder 5 formed in a sleeve like shape, a roller piston 6 accommodated in said cylinder 5 and arranged in an eccentric manner by and relative to the central axis of the cylinder and contacting at a portion of the periphery thereof with the portion of inner periphery of the cylinder 5 in a linear manner along axial direction of the axis. A helical groove 7 is formed in roller piston 6 so as to have decreasing pitch in the direction of the discharge portion of the compressor (left hand direction in the figure), a helical blade 9 is mounted in said helical groove in a manner to move freely in and out in the radial direction to form compressing space 8 between inner periphery of the cylinder 5 and piston surface, which space becomes smaller towards the left side in the figure. Sliding journal bearings 10*a* and 10*b* support both ends of the cylinder 5 and are fixed oppositely each other in the inner wall of said casing, with sliding journal bearings 12*a* and 12*b* being formed in the body of said sliding journal bearings 10*a* and 10*b* and supporting small shafts 11*a* and 11*b* projecting from the ends of the roller piston. Tally pin 13 projecting radially internally from the cylinder is provided to rotate roller piston 6 synchronously with the cylinder 5, and a tally hole 14 is formed on the roller piston 6. Further, the space 26 at the left hand side of the figure and formed with the cylinder 5 and the roller piston 6 communicates through the hole 15 formed in a portion of the sliding journal bearing 10*a* to the space 16 in which electric motor 4 is provided within the closed type casing 2. Also, the space 27 at the right hand side of FIG. 1 communicates through the hole 17 formed in a portion of the sliding journal bearing 10*b* to the low pressure gas supply tubing 18.

The electric motor 4 is an induction motor and is comprised of rotor 19 fixedly mounted on the external surface of the cylinder, and a stator 20 is arranged outside of the rotor 19 and affixed on the internal surface of the closed-type casing 2. Further, in FIG. 1, discharge tubing to discharge compressed gas is shown by 23 and lubricant oil to lubricate each sliding journal bearings is shown by 24.

Figure 3:
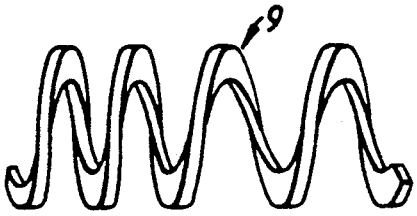
FIG. 3 is a side view showing the helical blade component of the compressor of FIG. 1.
Figure 4:
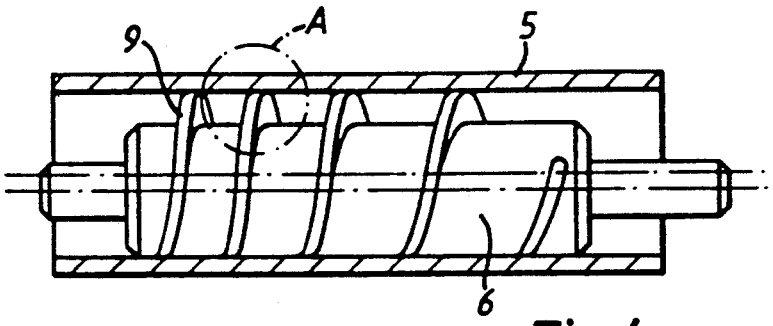
FIG. 4 is a longitudinal sectional view of the compressor mechanism subassembly of the compressor of FIG. 1.
Figure 5:
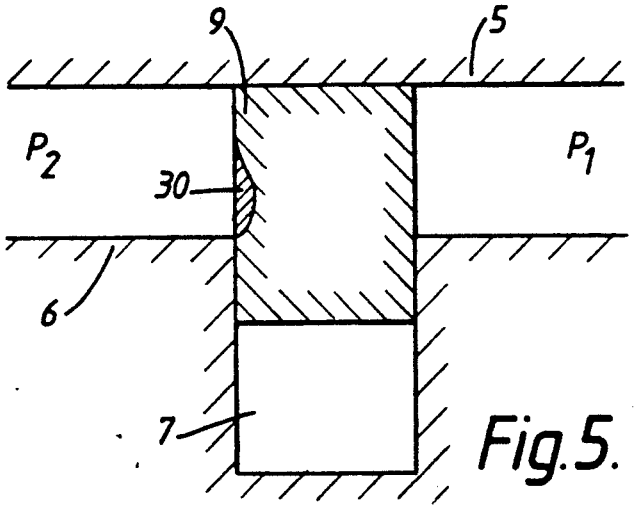
FIG. 5 is an enlarged schematic view of the portion of the roller piston on which the helical blade is mounted.

The helical blade 9 is, as shown in FIG. 3, made of solidified artificial resin of the types to be discussed hereinafter and is mounted in the helical groove 7 formed on the roller piston, as shown in FIG. 4. FIG. 5 is an enlarged cross sectional view of portion designated "A" in FIG. 4.

Figure 6:
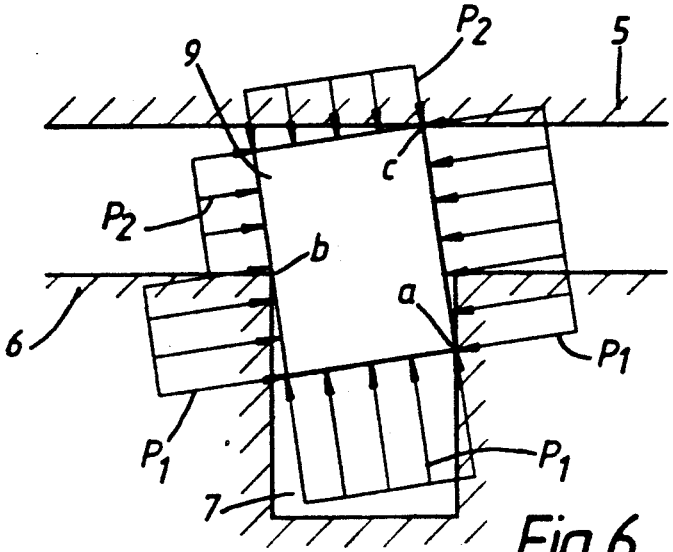
FIG. 6 is an enlarged schematic view of the portion of the roller piston on which the helical blade is mounted showing a distribution of pressure forces around the helical blade.

In the helical blade 9, in FIG. 5, the side surface portion in the lower pressure side shown as 30 is the portion most susceptible to wear. Thus, during operation, the helical blade 9 is apt to press against the lower pressure side in the slant condition and to be supported at three points (a, b and c) by the pressure difference as shown in FIG. 6. In this condition, around the helical blade 9, a high pressure $P_1$ on a high pressure side, a high pressure $P_1$ as a back pressure on the surfaces accommodating in the groove 7, a low pressure $P_2$ and a high pressure $P_1$ from a back pressure on the low to internal surface of the cylinder occur.

Figure 7:
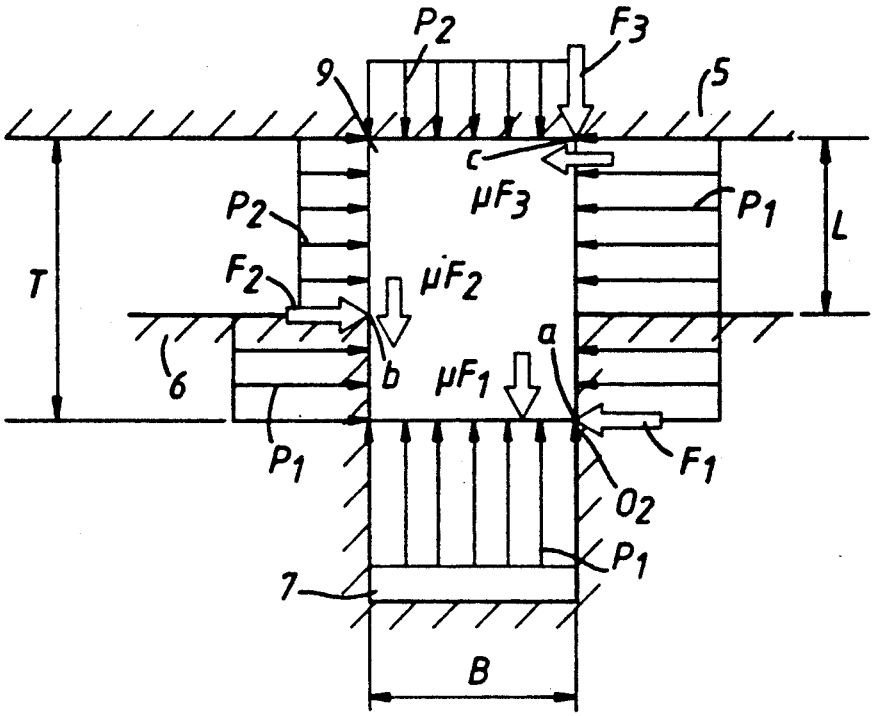
FIG. 7 is an enlarged schematic view of the roller piston portion on which the helical blade is mounted showing counter forces acting on the helical blade.

Also, on the three supporting points (a, b and c), concentrated reaction forces $F_1$, $F_2$ and $F_3$ act as counter forces from cylinder 5 and roller piston 6 as shown in FIG. 7. Further, on the helical blade, frictional forces act in accordance with the reaction force $F_1$, $F_2$ and $F_3$ respectively. Frictional forces are defined as $\mu F_1$, $\mu F_2$ and $\mu F_3$ respectively when the frictional coefficient is defined by $\mu$. The instantaneous directions of the frictional forces change by the relative motion among helical blade 9, cylinder 5 and roller piston 6 in one rotation cycle of the compressor mechanism and the distribution of forces at one instant of time is shown in FIG. 7.

These frictional forces act on the helical blade, and by these forces low pressure side shown in 30 is subject to increased wear except for constructions in accordance with the present invention. Specifically, in this embodiment of the present invention, wear is suppressed by designing cross-sectional form of the helical blade 9 as follows:

In FIG. 7, the balance equation of the forces and the moments are described as follows:

Balance of forces:

$$P_1T+F_1+\mu F_3=P_2L+P_1(T-L)+F_2 \quad (1)$$

$$P_2B+F_3+\mu F_2+F_1=P_1B \quad (2)$$

wherein the units of $F_1$, $F_2$ and $F_3$ in above equation (1) and (2) are kgf/m $$\int_O^B P_1xdx+\int_O^T P_1xdx+\mu F_3T= \quad (3)$$

$$\mu F_1B+F_3B+\int_O^B P_2xdx+\int_{T-L}^T P_2xdx+F_2(T-L)+\int_O^{T-L} P_1xdx$$

Further, assume the following dimension of the blades: T—blade height; L—exposition height; B—blade width; respectively. In this case, exposition height L varies between zero and the difference of the dimensions between the cylinder inner diameter and the outer diameter of roller piston during one rotation in the operation of the compressor.

Thus, when the pressure $P_1$ and $P_2$, blade dimension T, L and B and frictional coefficient are given, counter forces $F_1$, $F_2$ and $F_3$ received by blade are calculated from aforesaid three formulas (1), (2) and (3), as following formulas:

$$F_2=(\alpha/\beta)(P_1-P_2) \quad (4)$$

$$F_3=(-2\mu F_2+(B+\mu L)(P_1-P_2))/(1-\mu_2) \quad (5)$$

$$F_1=\{(1+\mu^2)F_2-(L+\mu B)(P_1-P_2)\}/(1-\mu^2) \quad (6)$$

wherein;

$\alpha=(B^2+2TL-L^2)/2$
$+\{-B^2(1-\mu^2)+\mu BT+\mu^2TL\}/(1-\mu^2)$ $\beta=T-L+\{\mu B(1+\mu^2)+2\mu(\mu T-B)/(1-\mu^2)$.

Figure 8:
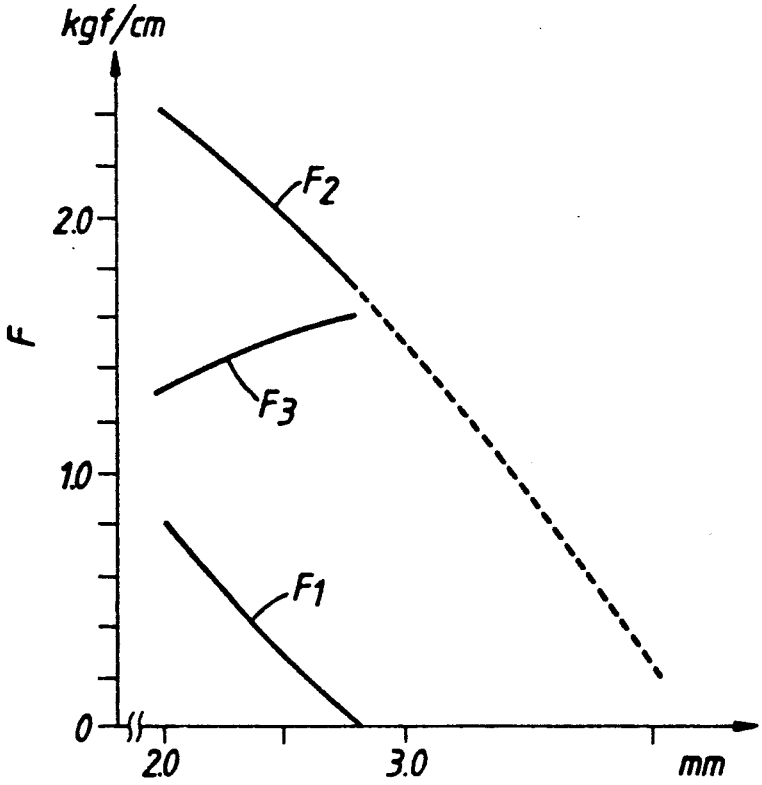
FIG. 8 is a graph showing variation of counter forces on the blade when the width of the helical blade is changed.
Figure 9:
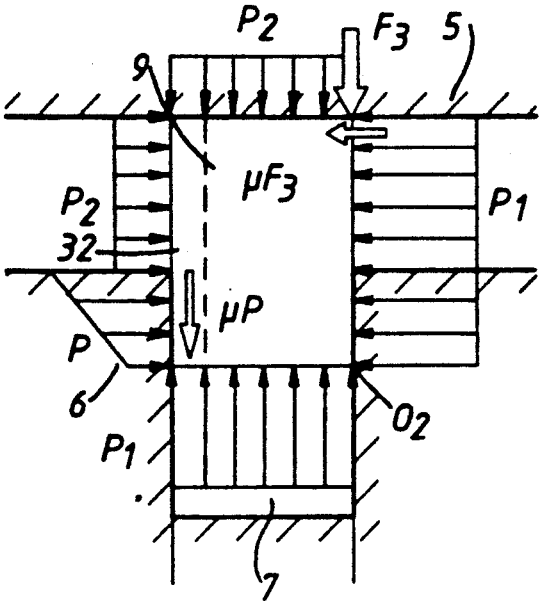
FIG. 9 is an enlarged schematic view of the roller piston portion on which the helical blade is mounted showing the counter force acting on the helical blade when width of helical blade is designed so as to make the counter force $F_1$ zero.

Now, when pressures $P_1$ and $P_2$ and blade dimensions T and L are given, reaction forces $F_1$, $F_2$ and $F_3$ are given as a function of blade width as shown in FIG. 8. In accordance with an increase of blade width B, since the effect of the moment of reaction force $F_3$ increases, reaction forces $F_1$ and $F_2$ become small. Thus at the borderline of the width of blade B where $F_1O$, the mode of the reaction forces varies as shown in FIG. 9, with the reaction forces changing from concentrated forces to distributed forces. When the reaction force changes to such a distributed condition, compression operation can be continued without causing excess blade wear. The condition for the force change is given from equation (6) as follows:

$$(1+\mu^2)(\alpha/\beta)\geqq(L+\mu B) \quad (7)$$

Figure 10:
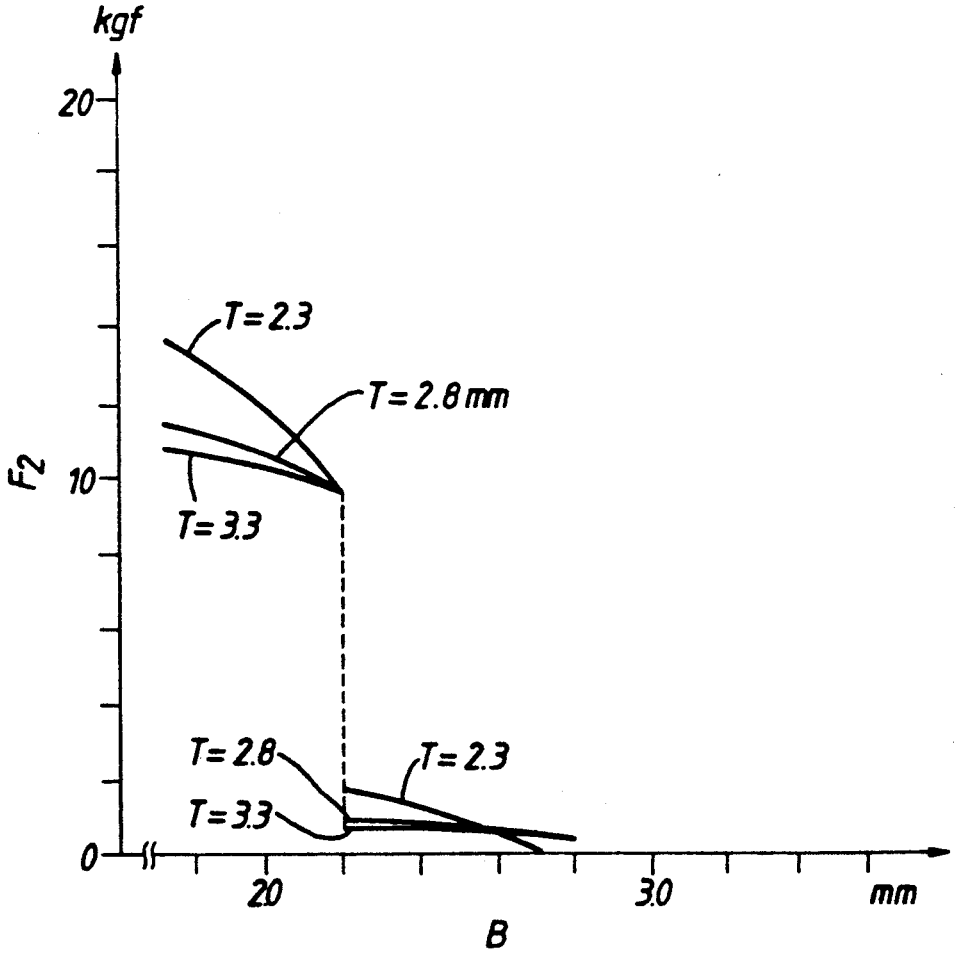
FIG. 10 is a graph showing variation of the largest blade surface force according to the width of the blade, and FIGS. 11(*a*) and 11(*b*) and FIGS. 12(*a*) and 12(*b*) are enlarged schematic cross-sectional views of the helical blade to describe experimental results.

In FIG. 10, there is shown an example in which reaction force $F_2$ changes to a distributed force from a concentrated force as a function of blade width B. For the pressure difference $(P_1-P_2)=3.2$ Kgf/cm$^2$, and blade dimensions T(variable), L=1.8 mm, and frictional coefficient $\mu=0.1$, the threshold value of blade width B for the change is given at B =2.2 mm. When using a blade having larger width than that value, $F_1$ becomes zero and $F_2$ becomes a distributed load and is able to improve durability of the helical blade.

According to the present invention the dimension of the cross-section of the helical blade 9 is also designed as follows.

For $\mu=0$ (there is no friction between the blade and the piston), the equation (1) is changed as follows;

$$B=B_0>L\ max \quad (8)$$

For $\mu>0$ (there is some friction), the equation (8) is changed as follows;

$$B>B_0 \quad (9)$$

Therefore the present invention is characterized in that the helical blade has a width B in the direction along the axis of the roller piston, wherein the Width B is at least always greater than the maximum value of the exposing height from the helical groove L max, that is, B>L max.

The helical blade according to present invention is preferably made of the solidified artificial resin materials described hereunder.

(1) Heat resisting high molecular weight compounds such as polyimides, polyamideimides, and polyetherketones.

(2) Fluorine-contained polymers including liquid crystal polymer as reinforcing-members such as aromatic polyamides and aromatic polyesters.

(3) Fluorine-contained polymers including glass fibers as reinforcing-members and wherein the glass fibers are dissolved and removed from the surface of the blade with hydrofluoric acid.

(4) Fluorine-contained polymers including glass fibers as reinforcing-members and the combination of at least one high molecular weight compound and a liquid crystal polymer, both of which are the same as described above, and wherein the glass fibers are dissolved and removed from the surface of the blade with hydrofluoric acid.

Further, a metal facing plate can optionally be put on the helical blade made of the materials described above with the surface of the metal plate disposed for contacting the inner surface of the cylinder and/or the low pressure side of the rotor groove. FIG. 9 shows a schematic of a facing plate 32 (shown dotted) positioned on blade 9 to contact the low pressure side of helical groove 7. Generally, facing plate 32 can be 10–20% of the width B of blade 9, and should be formed of a metal exhibiting low frictional resistance to sliding movement against the material of rotor piston 6.

In the following, the operation of the compressor in accordance with the aforesaid description will be described.

When the electric motor 4 is caused to rotate, cylinder 5 rotates at the same rotating speed as that of rotor 19 of said motor. Also, roller piston 6 rotates synchronously with cylinder 5 by means of the tally function of tally pin 13 and tally hole 14. As stated before, the axial line of the roller piston 6 is offset by a distance e from the axial line of the cylinder 5 (see FIG. 1), and also the helical blade is provided such as to move freely radially in and out from the helical groove the blade decreasing in pitch in the direction of the suction side of the compressor (right side in FIG. 1). Therefore, the compression space 8 defined by the cylinder 8, the roller piston 6 and the helical blade 9 moves towards left side of FIG. 1 so as to reduce its volume and consequently a lower pressure gas inhaled from right end space 27 is compressed as it moves to the left hand space 26. The compressed gas thus moved is discharged through hole 15 into space 16 in the casing and thus the function of the compressor is provided.

Figure 11A:
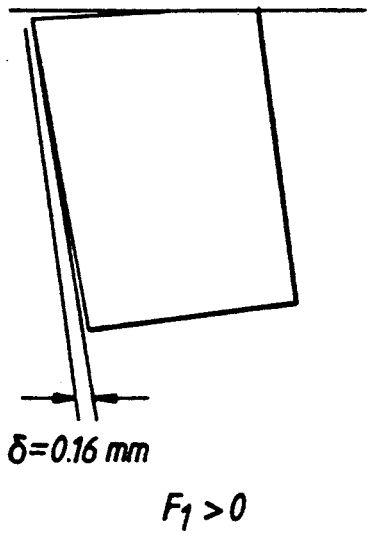
Figure 11B:
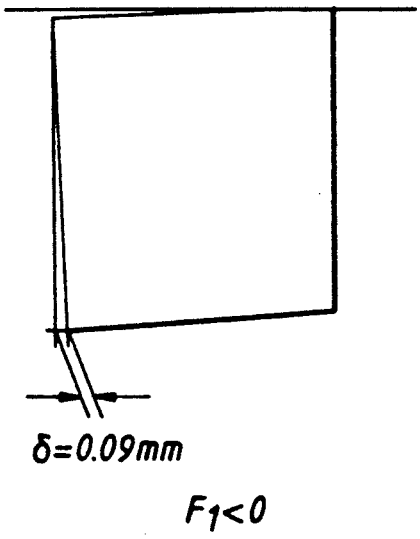

Further, when as in this case, the cross-sectional dimensions of the helical blade are designed to satisfy equation (7), the durability of the helical blade 9 can be improved. FIG. 11 shows the performance in terms of changes in the cross-section of the helical blade after testing conducted in an actual machine. FIG. 11(*a*) shows the case of $F_1>0$ and in this case wear of 0.16 mm is observed after 100 hours of operation. Also FIG. 11(*b*) shows the case of $F_1=0$, thus satisfying equation (7), wear of 0.09 mm only is observed after 100 hours of operation. From these facts, the usefulness of the present invention may be understood.

While the relationship defined by equations (8) and (9) are helpful for initial design considerations and for very low friction coefficients, the following examples demonstrate the surprising results achievable when the blade width is configured in accordance with the equation (7) for wear tests of the same duration.

Figure 12B:
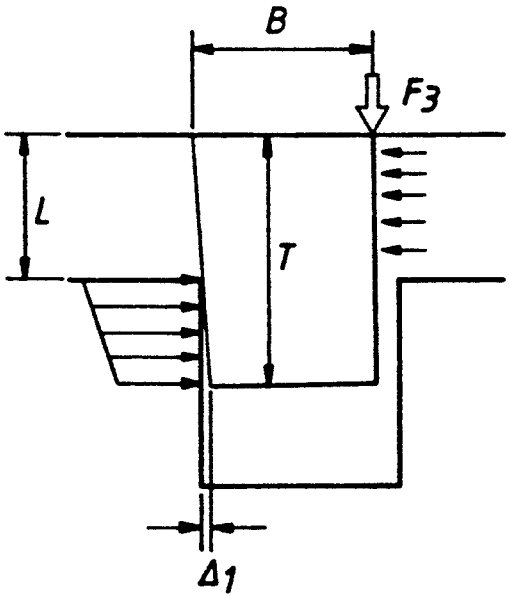
Figure 12B:
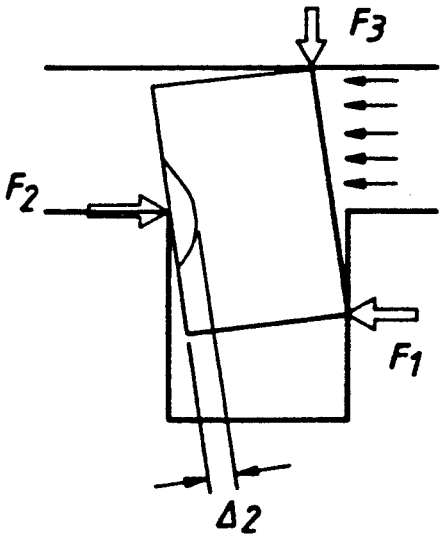

FIGS. 12(*a*) and 12(*b*) present test results for a compressor rotor having dimensions of T=3.4 mm, L=2.4 mm and $\mu=0.1$. In FIG. 12(*a*), the blade width B was chosen based on the value obtained when the dimension values were substituted in the equation $$(1+\mu^2)(\alpha/\beta)<(L+\mu B)$$

and the requirement of B>2.9 mm was calculated. For the FIG. 12(*a*) test, B was selected to be $\epsilon$ 3.0 mm and the wear observed ($\delta_1$) was 0.06 mm. For comparison, FIG. 12(*b*) is the case of B=2.5 mm, that is, satisfying the approximate design relationship B>L max of equations (8) and (9), and maximum amount of wear $\delta_2$ was 0.12 mm. Moreover, the distributed wear found in the FIG. 12(*a*) configuration test is clearly preferred to the cavity wear found in the FIG. 12(*b*) test.

While the blade design configurations resulting from the application of approximate equations (8) and (9) are still highly useful and are to be preferred over the conventional blade constructions, the blade configurations resulting from the application of equation (7) are highly preferred, particularly for large values of $\mu$.

The present invention is not limited to the embodiment described above and it is possible to modify the invention without deviating from the spirit of the invention. The following claims are intended to cover such modifications as well.

What is claimed is:

1. A fluid compressor comprising:

a rotatively driven cylinder; a roller piston installed in said cylinder in an eccentric manner and rotatable in synchronism with said cylinder; a helical groove formed on a peripheral surface of said piston; and a helical blade accommodated in said groove; said blade being freely movable radially in and out from said groove, wherein said helical blade has a width B in the direction along axis of said roller piston, a height T in the direction perpendicular to said axial direction, and exposing height L measured above said helical groove, and a frictional coefficient $\mu$, the width B satisfying the following formula:

$$(1+\mu^2)(\alpha/\beta)<(L+\mu B)$$

in which $$\alpha=(B^2+2TL-L^2)/2+\{-B^2(1-\mu^2)+\mu BT+\mu^2TL\}/(1-\mu^2)$$

$$\beta=T-L+\{\mu B(1+\mu^2)+2\mu(\mu T-B)\}/(1-\mu^2)$$

respectively.

2. The fluid compressor according to claim 1, wherein the helical blade is made of at least one material selected from the group consisting of heat resisting high molecular weight compounds including polyimides, polyamideimides, and polyetherketones.

3. The fluid compressor according to claim 1, wherein the helical blade is made of at least one material selected from the group consisting of fluorine-contained polymers, the blade further including liquid crystal polymers as reinforcing-members.

4. The fluid compressor according to claim 1, wherein the helical blade is made of at least one material selected from the group consisting of fluorine-contained polymers, the blade further including glass fibers as reinforcing-members, wherein the glass fibers are dissolved and removed from the surface of the blade.

5. The fluid compressor according to claim 1, wherein the blade is formed from a solidified artificial resin, the fluid compressor further comprising a metal facing plate disposed on the helical blade with the surface of the metal plate oriented for contacting the inner surface of the cylinder.

6. The fluid compressor according to claim 1, wherein the value of L is about 1.8 mm to 2.4 mm and the value of $\mu$ is about 0.1.

7. A fluid compressor comprising:

a rotatively driven cylinder; a roller piston installed in said cylinder in an eccentric manner and rotatable in synchronism with said cylinder; a helical groove formed on a peripheral surface of said piston; and a helical blade accommodated in said groove; said blade being freely movable radially in and out from said groove, wherein said helical blade has a width B in the direction along axis of said roller piston and a maximum exposing height L max measured above said helical groove, the width B satisfying the following formula:

$$B>L\ max.$$

8. The fluid compressor according to claim 2, wherein the helical blade is made of at least one material selected from the group consisting of heat resisting high molecular weight compounds including polyimides, polyamideimides, and polyetherketones.

9. The fluid compressor according to claim 2, wherein the helical blade is made of at least one material selected from the group consisting of fluorine-contained polymers, the blade further including liquid crystal polymers as reinforcing-members.

10. The fluid compressor according to claim 2, wherein the helical blade is made of at least one material selected from the group consisting of fluorine-contained polymers, the blade further including glass fibers as reinforcing-members, wherein the glass fibers are dissolved and removed from the surface of the blade.

11. The fluid compressor according to claim 2, wherein the blade is formed from a solidified artificial resin, the fluid compressor further comprising a metal facing plate disposed on the helical blade with the surface of the metal plate oriented for contacting the inner surface of the cylinder.

12. The fluid compressor according to claim 2, wherein the value of L is about 1.8 mm to 2.4 mm and the value of $\mu$ is about 0.1.

* * * * *

UNITED STATES PATENT AND TRADEMARK OFFICE

CERTIFICATE OF CORRECTION

PATENT NO. : 5,163,827

DATED : November 17, 1992

INVENTOR(S) : Kazuhisa Sumida

It is certified that error appears in the above-identified patent and that said Letters Patent is hereby corrected as shown below:

Abstract, item [57], line 16, change

"$\beta=T-L+\{\mu B(1+\mu^2)+(2\mu(\mu(\mu T-B)\}/(1-\mu^2)$."

to --$\beta=T-L+\{\mu B(1+\mu^2)+2\mu(\mu T-B)\}/(1-\mu^2)$--.

Signed and Sealed this

Eighteenth Day of January, 1994

*Attest:*

Bruce Lehman

BRUCE LEHMAN

*Attesting Officer*

*Commissioner of Patents and Trademarks*